US008499389B2

(12) United States Patent
Kirchhoff

(10) Patent No.: US 8,499,389 B2
(45) Date of Patent: Aug. 6, 2013

(54) MOLDED PRODUCT AND USE THEREOF

(76) Inventor: Tobias Kirchhoff, Münster (DE)

( * ) Notice: Subject to any disclaimer, the term of this patent is extended or adjusted under 35 U.S.C. 154(b) by 337 days.

(21) Appl. No.: 12/735,847

(22) PCT Filed: Feb. 18, 2009

(86) PCT No.: PCT/EP2009/051930

§ 371 (c)(1),
(2), (4) Date: Aug. 20, 2010

(87) PCT Pub. No.: WO2009/103740

PCT Pub. Date: Aug. 27, 2009

(65) Prior Publication Data

US 2011/0000018 A1 Jan. 6, 2011

(30) Foreign Application Priority Data

Feb. 21, 2008 (DE) ..... 10 2008 010 380

(51) Int. Cl.
*A47C 17/00* (2006.01)
*A47C 21/04* (2006.01)

(52) U.S. Cl.
USPC ..... 5/697; 5/421; 5/740

(58) Field of Classification Search
USPC .... 5/655.9, 740, 953, 421, 284, 697; 219/217
See application file for complete search history.

(56) References Cited

U.S. PATENT DOCUMENTS

| | | | | |
|---|---|---|---|---|
| 7,176,419 | B2 * | 2/2007 | Ellis et al. | 219/528 |
| 2004/0195227 | A1 * | 10/2004 | Park | 219/217 |
| 2006/0151459 | A1 | 7/2006 | Ku | |
| 2007/0013213 | A1 | 1/2007 | Axinte | |
| 2007/0056957 | A1 | 3/2007 | Diemer et al. | |
| 2007/0272673 | A1 * | 11/2007 | Keane | 219/212 |
| 2011/0252562 | A1 * | 10/2011 | Mikkelsen et al. | 5/421 |
| 2011/0289683 | A1 * | 12/2011 | Mikkelsen et al. | 5/421 |

FOREIGN PATENT DOCUMENTS

| | | | |
|---|---|---|---|
| DE | 37 16 263 | A1 | 11/1988 |
| DE | 29800506 | U1 | 10/1998 |
| DE | 19900257 | A1 | 7/2000 |
| DE | 20 2006 01347 | U1 | 12/2006 |
| GB | 426 210 | A | 3/1935 |
| WO | 2004105440 | A2 | 12/2004 |
| WO | 2006013391 | A2 | 2/2006 |

* cited by examiner

*Primary Examiner* — Robert G Santos
*Assistant Examiner* — Richard G Davis

(57) ABSTRACT

In order to adjust the firmness of a shaped product in a targeted way, it is proposed to provide at least one section made of a thermoelastic and viscoelastic plastic, a temperature-regulating device placed in thermal contact with the at least one section made of thermoelastic and viscoelastic plastic, and a control device for the temperature-regulating device configured to adjust the firmness of the at least one section made of thermoelastic and viscoelastic plastic by changing the temperature. Such a shaped product can be used as a seat base or bed support.

28 Claims, 7 Drawing Sheets

MOLDED PRODUCT AND USE THEREOF

FIELD OF THE INVENTION

The present invention relates to a shaped body, i.e. a body having a shape, for use as a bed support or a seat base, a control device for such a moulded body, a method for the adjustment of the firmness of such a shaped body, a computer program product, and also various applications of such a shaped body.

BACKGROUND AND THE PRIOR ART

Moulded bodies for use as bed supports or seat bases are found in a very wide variety of forms, such as mattresses and cushions, also seating in the home, or in means of transport. Such items are used not only by people, but also by animals.

What is common to all these moulded bodies is that the user feels a certain level of firmness. The force that a user exerts on the shaped body depends on his weight and his movements. At the same time the shaped body exerts a counterforce, where the system of user and shaped body pursues a state in which the force and counterforce are in equilibrium with one another. This state is called the quiescent state.

In most types of use the user is not completely stationary, but rather performs constantly changing movements that on each occasion require the adjustment to a new force equilibrium. In materials with a certain level of compliance, an alteration of shape occurs in reaction to the forces, or alterations in force, exerted by the user. The force that a user must exert so as to impress a shaped body is perceived by the user as firmness. If the material takes the form of a foamed material one also talks about compression hardness.

Estimation of the level of firmness as high or low can on the one hand be subject to subjective variability. The firmness of a shaped body can, however, also alter during the course of its lifetime of usage. Thus the original firmness of a shaped body can indeed be tested before purchase by sitting or lying on it. If the firmness of the shaped body alters in the course of time, the user has only a few options for correcting the firmness to the desired value. In the case of mattresses that are supported on slatted frames, for example, it is possible to move sliders on the slatted frame so as to adapt the firmness of the slatted frame. A further option of known art consists in altering the firmness of the shaped body by means of alterations of volume or density. For this purpose air or water bladders are normally used; these are introduced into or onto the shaped body.

What is common to all these procedures is that they require larger modifications and thus are very resource-intensive; they are therefore only carried out for alterations to the firmness that are meant to persist over longer time periods.

SUMMARY OF THE INVENTION

It is a object of the present invention to identify an option by means of which possible alterations to the firmness of moulded bodies that do not need much effort can be undertaken also for the short term.

This object is achieved by means of a shaped body for use as a bed support or seat base, which has:

- at least one section of thermoelastic and viscoelastic plastic material,
- a temperature-regulating device, which is arranged in thermal contact with the at least one section of thermoelastic and viscoelastic plastic material, and

- a control device for the temperature-regulating device, which is equipped to adjust the firmness of the at least one section of thermoelastic and viscoelastic plastic material in a controlled manner, via alteration of the temperature.

Under a thermoelastic and viscoelastic plastic material is here to be understood a plastic material, whose firmness, respectively elasticity, alters significantly with its temperature. That is to say, the temperature-dependent alterations in firmness are so large that they can be discerned by the user without special measuring equipment by his own means of perception. Moreover the material is distinguished by the fact that it returns only slowly to its original shape after pressure has been exerted onto it. This effect is also called the slow recovery effect and leads to pressure-reducing characteristics and a very good pressure distribution.

The section or sections of thermoelastic and viscoelastic plastic material can systematically be arranged at locations in the shaped body, at which an easily variable firmness is particularly acceptable, such as in the shoulder or heel area, when used as a bed support, or in the back area as a lumbar support, when used as a seat base. Here the section or sections of thermoelastic and viscoelastic plastic material can be combined with sections of a variety of other materials, such as are conventionally used for moulded bodies of this kind, such as foams, latex, steel springs, or down or feather fillings. The section of thermoelastic and viscoelastic plastic material can, however, also be so large that it substantially forms the shaped body.

The temperature-regulating device serves to modify the temperature of the at least one section of thermoelastic and viscoelastic plastic material, and thereby influence its firmness. Depending on the thermoelastic and viscoelastic plastic material and the normal ambient temperature when using the shaped body, some raising or lowering of its temperature will be necessary to achieve the desired firmness. The temperature-regulating device can be designed such that it maintains an essentially homogeneous temperature distribution over the whole of the at least one section of thermoelastic and viscoelastic plastic material. However, it can also be designed such that it allows non-homogeneous temperature distributions to be systematically adjusted, leading to distributions of firmness over the at least one section of thermoelastic and viscoelastic plastic material. The temperature-regulating device is then controlled via a control device, in which the correlation between firmness of the actual shaped body and its temperature is stored. This can take a simplest form in which for low firmness the temperature-regulating device is switched on, and for high firmness it is switched off. Via electrical circuit elements the temperature-regulating device can be switched to a higher temperature for a lesser firmness and to a lower temperature for a greater firmness, while intermediate values can also be set as necessary. The detailed relationship between a large number of firmness values and temperatures for the thermoelastic and viscoelastic plastic material used in each case can also be stored as data in a memory and/or in the form of an algorithm, accessed by a microprocessor so as to convert an input concerning a desired firmness into a required temperature range and to generate from this a corresponding output signal to the temperature-regulating device.

By the systematic supply of heating or cooling to the at least one section of thermoelastic material its firmness is influenced in a controlled manner, without any resource-intensive modification of the shaped body being necessary. By manual or automatic operation of the control device it is possible for the user to adjust to the firmness, or firmness distribution, actually desired at all times.

The object is also achieved by means of a control device for an above-described shaped body; this device is equipped to adjust the firmness of one or a plurality of sections of thermoelastic and viscoelastic plastic material in a controlled manner via alteration of the temperature.

Moreover, the object is achieved by means of a method for the setting of the firmness of an above-described shaped body, with the steps:

input of a desired firmness distribution, determination of the temperature distribution necessary for this purpose, setting of the derived temperature distribution in the shaped body by means of the temperature-regulating device, and also by means of a computer program product, which contains computer-readable instructions and, when executed on a suitable system, executes such a method.

Furthermore, the object is achieved by the use of an above-described shaped body as a mattress, futon, cushion, upholstered component of a upholstered bed, padded component of a wheelchair, or an overlay for one of the above-named items, in particular for the purpose of decubitus prophylaxis, or also as a component of a chair, armchair, sofa, wheelchair, motor vehicle, rail or aircraft seat, or as an overlay for one of the above-named items.

Advantageous embodiments are to be found in the dependent claims.

BRIEF DESCRIPTION OF THE DRAWINGS

The present invention will be explained more in detail with reference to preferred examples of embodiment. In the figures.

DETAILED DESCRIPTION OF THE INVENTION

Figure 1A:
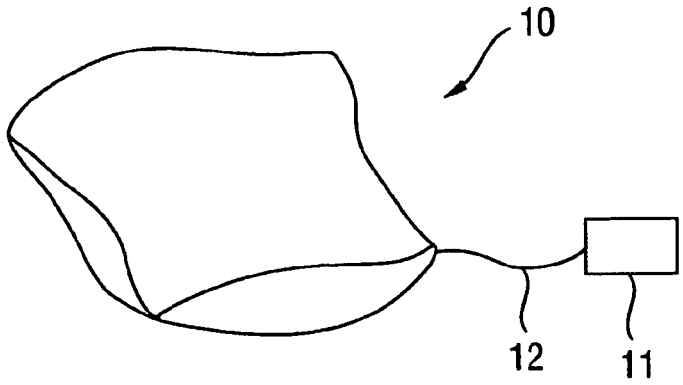
FIG. 1*a* shows schematically in perspective an embodiment of the shaped body as a cushion.

In FIGS. 1*a,b* an embodiment of the shaped body with a variably adjustable firmness is illustrated schematically as a cushion 10. The cushion 10 is connected to a control unit 11 via a cable connection 12. In its interior the cushion 10 consists of a plurality of layers. Its basic component is a section 13 of thermoelastic and viscoelastic plastic material. For use of the shaped body as a bed support or a seat base foamed plastic materials, in particular cold foamed plastic materials, are particularly preferred. In a particularly preferred embodiment, the section 13 of the cushion 10 consists of a polyurethane foam, which is thermoelastic and viscoelastic. Foamed materials, in particular polyurethane foams, which have a density of approx. 25 kg/m$^3$ to approx. 85 kg/m$^3$, particularly preferred a density of approx. 30 kg/m$^3$ to 65 kg/m$^3$ have proven to be particularly suitable.

Figure 13:
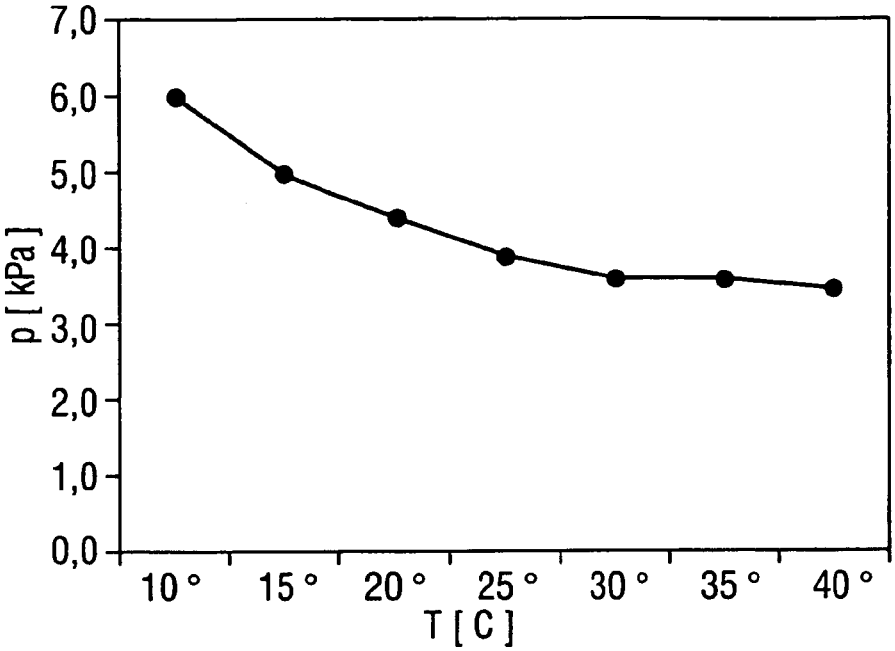
FIG. 13 shows the dependence of the firmness of a thermoelastic and viscoelastic polyurethane foam as a function of the temperature.

FIG. 13 illustrates in an exemplary manner the relationship for a thermoelastic and viscoelastic polyurethane foam between its firmness and its temperature. In the example illustrated here this concerns the foamed material V5040 from the company Eurofoam Deutschland.

At temperatures of 10° C., 15° C., 20° C., 25° C., 30° C., 35° C. and 40° C. the pressure required in each case to compress the foamed material to 40% of its original thickness was measured in kPa. In particular a clear temperature dependence for the foamed material measured can be discerned in the temperature range between 10° C. and 30° C.; a transition into a saturation region then occurs: while at 10° C. a pressure of 6.0 kPa is necessary to compress the foamed material to 40% of its original thickness, in the range from 30° C. to 40° C. only between 4.0 kPa and 3.0 kPa is necessary for this purpose. Each thermoelastic and viscoelastic plastic material can be characterised in terms of the temperature dependence of its firmness by means of simple measurements. The relationship between firmness and temperature for the thermoelastic and viscoelastic plastic material in question can be used to control the temperature-regulating device, so as to adjust to the desired levels of firmness of the shaped body. The thermoelastic and viscoelastic plastic materials that are preferably used are those whose firmness has a temperature dependence in the temperature range in particular between about 20° C. and about 35° C.

Figure 1B:
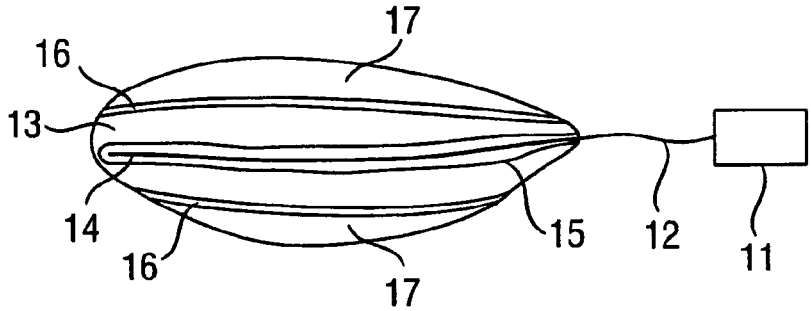
FIG. 1*b* shows schematically in section the cushion from FIG. 1*a;*

In the present example electrical heating is utilised as the temperature-regulating device, which has the particular feature that heat is generated via electrically conducting textile threads 14, which here are arranged centrally in the section 13. They are covered by a shield 15, which shields electromagnetic radiation as far as possible. This is particularly important, if the cushion 10 is to be used as a head pillow. In the selection of the material for the arrangement shown in FIG. 1*b* care should be taken that it has a good thermal conductivity, so that despite the shielding 15 there is thermal contact between the electrically conducting textile threads 14 and the section 13, in order that the firmness of the section 13 can be systematically influenced via alterations in temperature. The shielding can also be arranged further outwards. In this case, particular care should be taken in the selection of the material, such that it allows air and moisture to pass through unhindered and does not negatively influence the climatic properties of the shaped body in question.

In the example shown in FIG. 1, the temperature-regulating device is controlled via the control unit 11, which increases or reduces the supply of power into the electrically conducting textile threads 14, so that more or less energy is dissipated as heat as it passes through the textile threads. The dissipated heat permeates into section 13, whose firmness is correspondingly altered.

For an increased level of recumbent comfort, a section 17 of down is provided on the upper and lower sides of the cushion 10. Moreover, heat reflectors 16 are provided at the boundaries between sections 13 and 17. They serve to prevent transfer of heat from the temperature-regulating device, in other words from the textile threads, in the example shown in FIG. 1. Here, the heat generated is just used to influence the firmness, without it being detected by the user. In a particularly preferred embodiment the heat reflectors 16 have one side that reflects heat more strongly than the other; in the present example this side is arranged facing towards the textile threads 14.

Figure 2A:
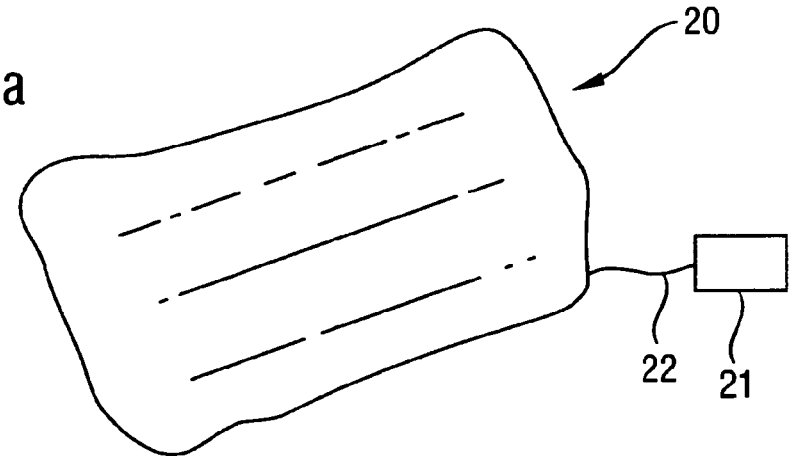
FIG. 2*a* shows schematically in perspective an embodiment of the shaped body as a futon.
Figure 2B:
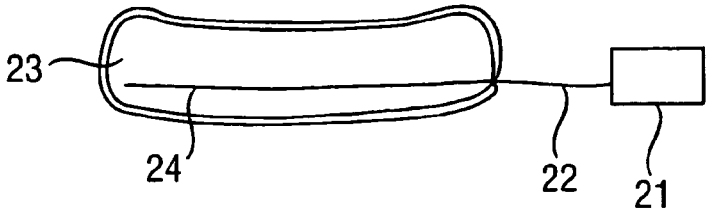
FIG. 2*b* shows schematically in section the futon from FIG. 2*a;*

In FIGS. 2*a,b* an embodiment of the shaped body with a variably adjustable firmness is illustrated schematically as a futon 20. The futon 20 is connected via a cable connection 22 to a control unit 21, which as a temperature-regulating device controls the electrical heating based on heating wires 24. The futon 20 consists essentially of the section 23 of thermoelastic and viscoelastic plastic material, for example a polyurethane foam, or another suitable thermoelastic and viscoelastic plastic material. The futon 20 is covered by an allergen-blocking layer 25. This allergen-blocking layer 25 serves primarily to prevent any nesting of mites in the futon 20, or any emergence of mites from the futon 20. The material of the layer 25 is preferably not only non-permeable to allergens, but is also permeable to air, so as not to impair the climatic properties of the futon 20 and to offer a pleasant level of recumbent comfort. At the same time a certain permeability to air prevents excessive heating of the futon 20 in the event of any malfunction of the controller 21.

Figure 3A:
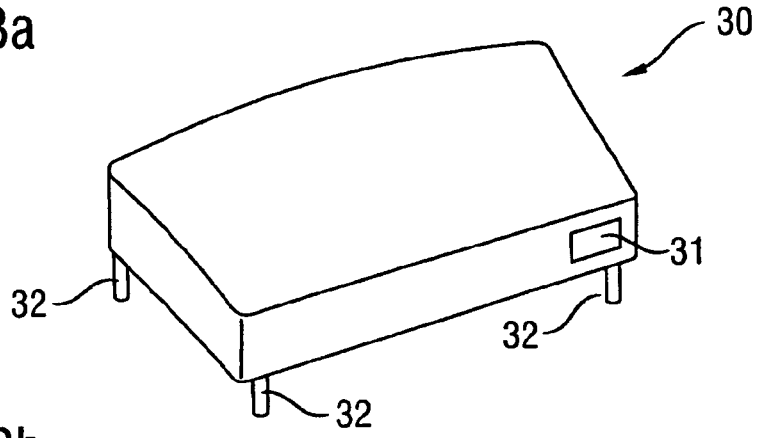
FIG. 3*a* shows schematically in perspective an embodiment of the shaped body as a upholstered bed.
Figure 3B:
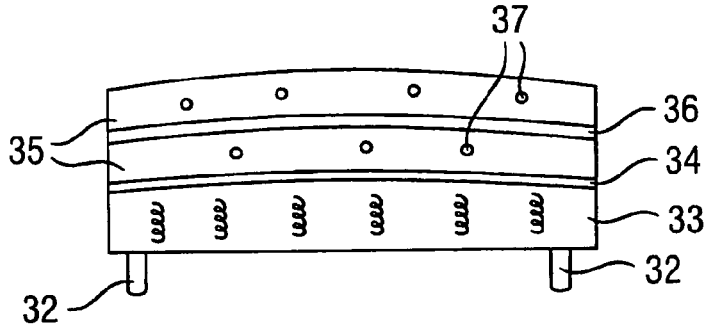
FIG. 3*b* shows schematically in section the upholstered bed from FIG. 3*a;*

FIGS. 3*a,b* show an embodiment of the variable-firmness shaped body as an upholstered bed 30. The base of the bed is raised on four supporting feet 32. In the example shown, the control unit 31 is integrated into the upholstered bed 30. The bottom-most part of the upholstered bed 30 is a section 33 with steel springs. Arranged on top of this section is a section 35 of thermoelastic and viscoelastic plastic material. A layer 36 with electrically conducting plastic material runs centrally through the section 35. This layer is supplied with power via the control unit 31, so as to generate heat dissipation in proportion to the flow of current; this heat dissipation influences the firmness of the upholstered bed.

The layer 36 can e.g. have a supporting layer of woven fabric or non-woven material, on which is located a supporting layer formed by means of a flexible film. It can, for example, take the form of a polyurethane, to which is added e.g. graphite to increase the conductivity. Preferably, the thermoelastic and viscoelastic plastic material of section 35 can itself also serve as a support.

To increase the sleeping comfort, ventilation ducts 37 are distributed in section 35 in accordance with orthopaedic principles. In addition, they serve to provide ventilation so as to prevent a build-up of heat in the upholstered bed 30. In addition, a heat reflector 34 is provided between sections 33 and 35. It reflects heat dissipated from the electrically conducting plastic material layer 36 into the section 35 of thermoelastic material and onto a user, if he is lying on the upholstered bed 30. In particular in the case of users for whom an excessive loss of body heat is a cause of concern when they are lying down, because they have poor blood circulation or are older, it can also be a welcome feature to use the heat generated not only for adjustment to the desired firmness, but also to heat the user.

Figure 4A:
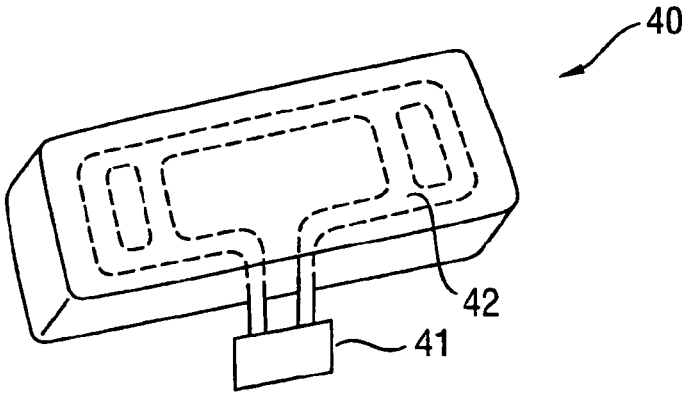
FIG. 4*a* shows schematically in perspective a first embodiment of the shaped body as a mattress.
Figure 4B:
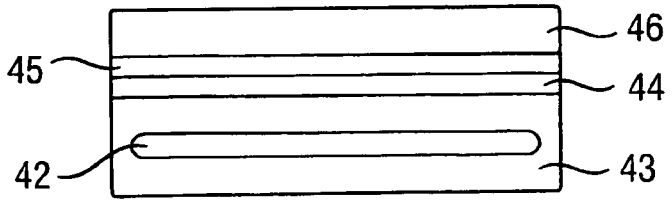
FIG. 4*b* shows schematically in section the mattress from FIG. 4*a;*

In FIGS. 4*a, b* an embodiment of the shaped body with a variably adjustable firmness as a mattress 40 is illustrated. The regulation of the temperature is achieved via the circulation of fluids through the section 43 of thermoelastic and viscoelastic plastic material. For this purpose, the control device is combined with a pump 41, which pumps e.g. air or water at the required temperature through the fluid ducts 42. Depending on the type of thermoelastic and viscoelastic plastic material used and the fluid used, the ducts can be drilled directly into the thermoelastic material. However, they can also have a wall of material that is non-permeable to the fluid, but is heat conducting. They can also be arranged adjacent to the section 43 of thermoelastic and viscoelastic material, as long as an appropriate transfer of heat takes place.

In the example illustrated, the fluid ducts 42 are arranged over the surface area such that in particular heat is supplied either to or from the area of the heels and the area of the head rest so as to alter the firmness. Cooling can be required, if the body heat supplied by the recumbent user would lead to an undesirably low firmness.

The mattress 40 illustrated in an exemplary manner in FIGS. 4*a, b* has a knitted fabric spacer 44 above the section 43 of thermoelastic and viscoelastic plastic material, so as to allow an airflow within the mattress 40. This reduces any undesirable, because difficult to control, heat transfer from or to the recumbent user. To improve the level of recumbent comfort, a gel layer 45 is provided on top of the knitted fabric spacer 44, which leads to a better pressure distribution; also provided is a foamed material layer 46, to increase the level of recumbent comfort. In further embodiments, the gel layer can also be used to provide thermal contact between the temperature-regulating device and one or a plurality of sections of thermoelastic and viscoelastic plastic material, if a gel with good heat conductance is selected.

It should be noted that temperature-regulating devices can also be configured such that they cumulate various kinds of heat transfer, e.g. fluid flow, for example for cooling purposes, and electrical heating.

Figure 5:
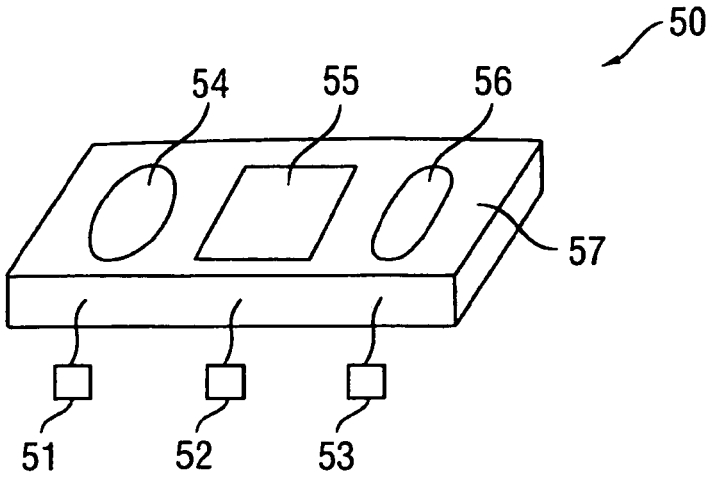
FIG. 5 shows schematically in perspective a second embodiment of the shaped body as a mattress.

A further embodiment of the shaped body with variable firmness as a mattress 50 is illustrated in FIG. 5. In the mattress 50, a plurality of sections 54, 55, 56 of thermoelastic and viscoelastic plastic material are provided; these are inserted into a latex mattress body 57 in the neck, lumbar and heels areas. Each of these sections 54, 55, 56 is connected to its own control unit 51, 52, 53. In this manner, it is possible to regulate the firmness in the neck, lumbar or heels areas as desired, independently of the firmness in the other areas. In a further variant a single control unit can also be provided that can accept inputs for the individual sections 54, 55, 56 and convert them into control signals for the respective temperature-regulating devices.

Figure 6:
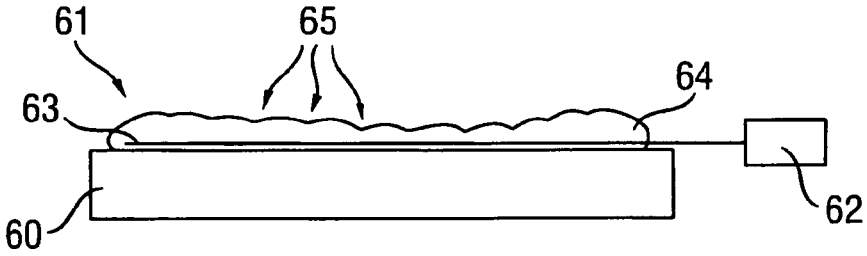
FIG. 6 shows schematically in section an embodiment of the shaped body as a mattress overlay.

FIG. 6 illustrates an embodiment as a mattress overlay 61, which is laid on top of a conventional mattress 60. The overlay 61 is essentially formed by the section 64 of thermoelastic and viscoelastic plastic material, through which passes a heating wire 63, and which is adjusted in its firmness by appropriate temperature regulation from a control unit 62. So as to allow a circulation of air between overlay 61 and the recumbent user, the aim of which is to prevent any build-up of heat, notches 65 are provided on the side of the overlay 61 facing towards the user. The distribution of the notches 65 over the overlay 61 is advantageously undertaken in accordance with orthopaedic principles.

Figure 7:
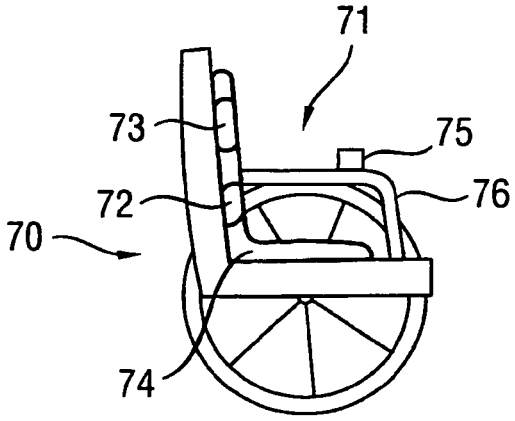
FIG. 7 shows schematically in section an embodiment of the shaped body as an overlay for a wheelchair.

An embodiment as an overlay, and in particular as a seat base 71 for a wheelchair 70, is illustrated in FIG. 7 in an exemplary manner. The seat base 71 consists essentially of a foamed material 74, into which two sections 72, 73 of thermoelastic and viscoelastic plastic material are inserted in the neck and lumbar areas. These sections 72, 73 are regulated in their temperature and thus their firmness as desired via a temperature-regulating device (not illustrated here). The temperature-regulating device is designed as an electrical heating unit, which for manually operated wheelchairs is supplied with current via an additional battery, and for electric wheelchairs is supplied with current via the already existing power supply. The control unit 75 is arranged on the arm rest, so that it can easily be reached and operated by the user.

It should be noted that embodiments as overlays can also be of smaller dimensions, so that they cover e.g. only a part of a mattress or seating, such as the back, neck, or lumbar areas, or others.

Figure 8:
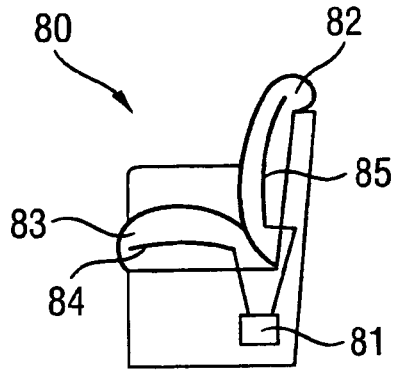
FIG. 8 shows schematically in section a form of embodiment of the shaped body as seating furniture.

FIG. 8 exemplarily illustrates an embodiment as an item of seating furniture 80. It can be embodied as a sofa, an armchair, or an upholstered chair with arm rests. A control unit 81 is integrated in the item of seating furniture 80 and adjusts the desired firmness of the upholstery items 82, 83 of thermoelastic and viscoelastic plastic material, by bringing them up to a temperature that corresponds to the desired firmness by means of separated heating wires 84, 85. Each heating wire 84, 85 can be controlled separately, so as to be able to adjust the firmness in the upholstery items 82, 83 independently of the respective other upholstery items. In particular if a user sits on an item of furniture for a long time, such as a recliner or a television armchair, from time to time an alteration of firmness is often sought by the user, and is also necessary on health grounds.

Figure 9:
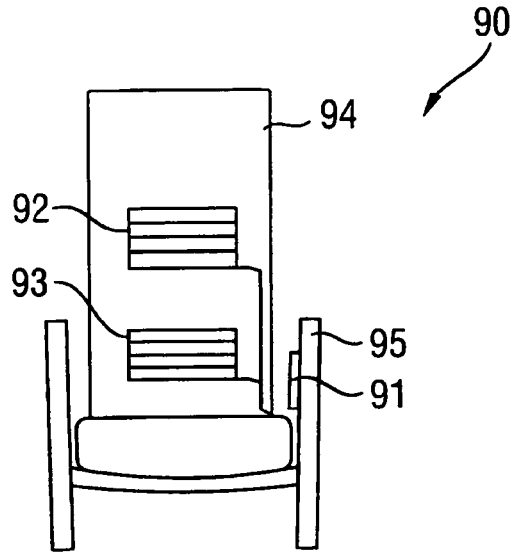
FIG. 9 shows schematically from the front an embodiment of the shaped body as a seat.

FIG. 9 illustrates a further embodiment. The embodiment takes the form of a seat 90, such as could be utilised in an aircraft, a train or a vehicle such as a car, bus, or truck. It could also be designed as an office chair. In the present example, the upholstery item 94 of the back rest is of thermoelastic and viscoelastic plastic material, on which arrangements of heating wires 92, 93 are adjacently provided in two areas. Both arrangements of heating wires 92, 93 can be controlled independently of one another by the control unit 91 fitted on the arm rest 95, so as to adjust to a desired firmness of the upholstery item 94 in the two back areas. In particular under certain conditions, an automatic change of levels of firmness during the seating period can have orthopaedic advantages e.g. as a lumbar support, but can also guard against excess fatigue and even short periods of sleep. In particular on long distance flights a seat with a variable firmness leads to improved blood circulation in the areas making contact with the seat, which is of advantage for both passengers and crew. This is also advantageous for office chairs.

Figure 10:
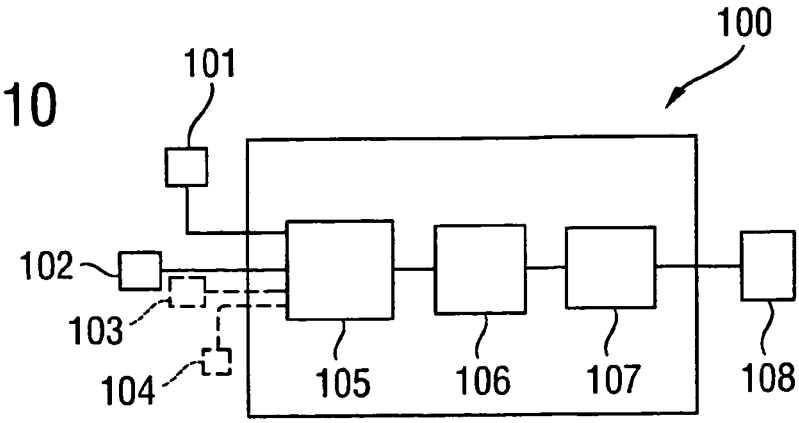
FIG. 10 shows a schematic diagram of an embodiment of the control device.

FIG. 10 illustrates the schematic structure of a possible embodiment of the control device 100. The main components are a unit 105 to establish a desired firmness distribution, a microprocessor 106, which serves to determine from the desired firmness distribution the corresponding required temperature distribution, and a unit 107 to output this required temperature distribution via a suitable interface 108 to a temperature-regulating unit. In the example illustrated, the unit 105 to establish a desired firmness distribution is connected with a user interface 101. It can take the form of an operator display, via which a desired current firmness value, possibly a pre-set firmness distribution over the whole variable-firmness seat base or bed support, or even a firmness profile over time, is manually inputted or selected from pre-set options. The user interface 101 can also be configured as a remotely operated device. In the simplest case, an operating switch can also be provided, which can be switched backwards and forwards between two firmness values. The control unit is thus equipped to interact with one or a plurality of temperature-regulating devices, in that an input concerning a desired firmness is converted into a required temperature range, be it mechanically, electrically, electromechanically, or electronically, and from this a corresponding output signal is generated for the temperature-regulating device(s).

Additionally one or optionally a plurality of sensors 102, 103, 104 are connected to the unit 105 for establishing a desired firmness distribution. In the case of the sensor or sensors 102, 103, 104 these can e.g. take the form of sensors that react to pressure or movement, and thus register body movements. They can also take the form of sensors that detect sleeping or waking phases on the basis of body functions. Amongst others these include sensors for the determination of breathing rate, oxygen content in the blood, pulse frequency, or blood pressure. An alteration in these parameters can e.g. initiate a profile over time for a firmness distribution, such as alterations in firmness at various points on a mattress during a sleep cycle with, for example, a weaker firmness distribution in the initial sleep phase, higher levels of firmness in the subsequent deep sleep phase and weaker levels of firmness once again during the REM phases. The transition from one sleep phase into the next can be detected by the sensors 102, 103, 104.

Furthermore the sensors can also take the form of temperature, respectively firmness, sensors, by means of which the current temperature, respectively firmness, can be controlled, so as to establish whether the desired condition has already been achieved.

A further application of variable firmness distributions over time is found in the regular changes in firmness in decubitus prophylaxis. Here the control device 100 can be adjusted for periodic alterations of firmness over the whole mattress or only in certain areas, without any manual actuation being necessary on the part of the bedridden user. The regular changes in firmness support good and regular circulation in all contact areas, so as to avoid bedsores.

In case of an embodiment of the shaped body as, for example, a mattress, the variable firmness distribution over time can also be used for awakening a recumbent person at a particular waking time by increasing the firmness for the purpose of preparing the body of the recumbent person.

Figure 11:
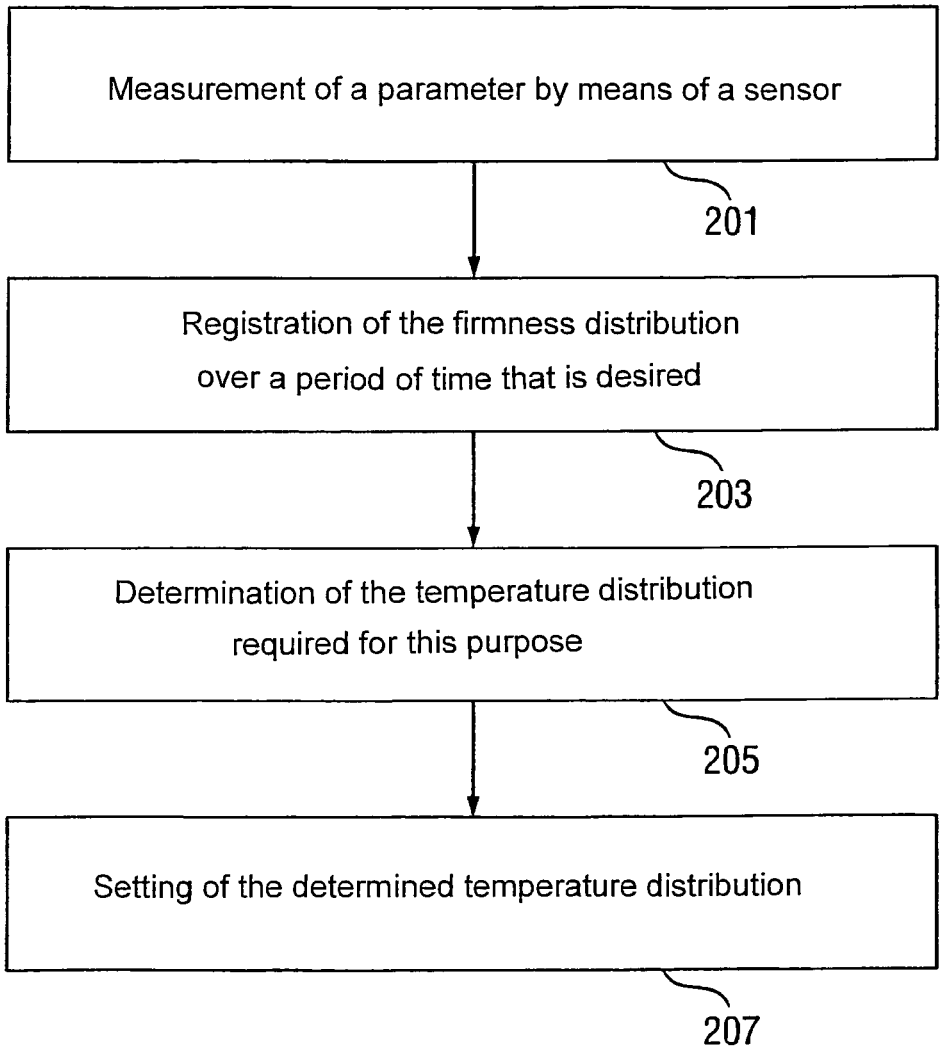
FIG. 11 shows a flow diagram of an embodiment of the method for adjusting the firmness of a shaped body.

From the inputs of the user and/or from the parameters measured by the sensors (see also step 201 in FIG. 11) the unit 105 establishes a desired firmness distribution over time (step 203). From this the microprocessor 106 determines the profile over time of the temperature distribution necessary for this purpose (step 205). The temperature values can e.g. be read out from stored data tables and/or calculated. The particular thermoelastic and viscoelastic properties of the section concerned, its geometry, and also the geometry and particular properties of the temperature-regulating device used should be taken into account. The individual parameters can be determined by means of simple measurements for each thermoelastic and viscoelastic plastic material. The required temperature distribution thus determined is adjusted via an output from the unit 107, via the interface 108, to the temperature-regulating device (step 207). So as to increase the level of comfort of the user, temperature gradients are preferably also specified for the adjustment of the required temperature distribution, so that the alteration in firmness is executed neither too rapidly nor too slowly.

Depending on the desired level of complexity of the adjustable levels of firmness or firmness distributions a microprocessor can be dispensed with in simpler variants of the control device, for converting inputs concerning a desired firmness into a required temperature range, or a required temperature, and from these to generate a corresponding output signal to the temperature-regulating device. For example the temperature-regulating device can be switched via a switch between a temperature that corresponds to a higher firmness, and a temperature that corresponds to a lower firmness. In variants of the type in which via a control device two, three, four perceptibly different levels of firmness can be adjusted, thermoelastic and viscoelastic plastic materials are preferably introduced in which these levels of firmness correspond to clearly different temperatures, although for reasons of minimised energy consumption and faster changes in firmness these temperatures are also not too far apart from one another. In particular in the case of moulded bodies operating in the temperature range between room temperature and body temperature, temperature steps of about 1.5° C. to 2.5° C. are appropriate.

Figure 12:
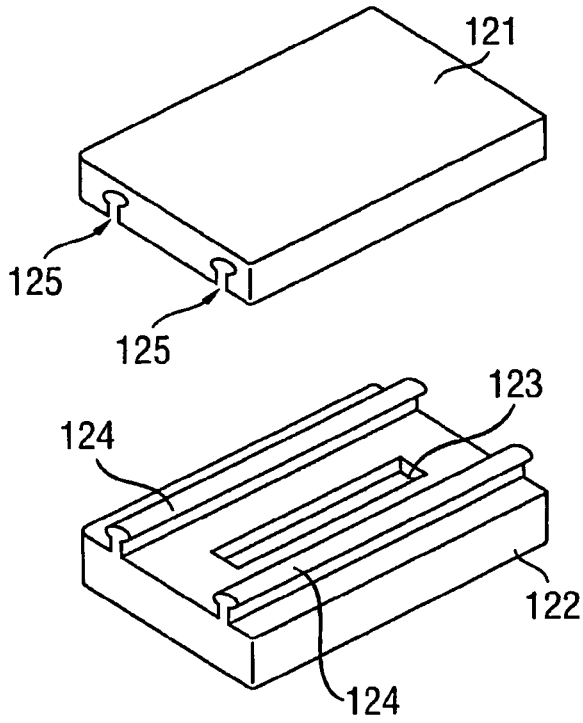
FIG. 12 shows schematically an example for the structure of a shaped body.

FIG. 12 illustrates an example of a possible structure of a shaped body. The shaped body has an upper part 121 and a lower part 122, which are illustrated in a separated condition. While the upper part 121 has two parallel channels in the form of grooves 125, the lower part 122 has two complementary strips in the form of feathers 124. By this means the upper part 121 and the lower part 122 can be connected in a simple manner and again separated as required. However, means other than the groove 125 and feather 124 can be provided to enable a form fit connection of the parts.

A recess 123 is provided in the lower part 122, into which the temperature-regulating device and/or the control device can be inserted partially or completely. Here, depending on the embodiment, only one or both of the upper and lower parts 121, 122 are of thermoelastic material. By integration of the temperature-regulating device and/or control device into the interior of the shaped body the space requirement is on the one hand reduced to a minimum, while on the other hand each integrated device is well protected from external effects. Moreover with integration of the temperature-regulating device good thermal contact is provided with the respective section of thermoelastic material so as to alter its firmness. For maintenance purposes the lower and upper parts 122, 121 can simply be separated so as to allow access to the integrated devices.

Furthermore, embodiments of the shaped body are possible that have more than two parts that can be connected in a form fit. Likewise more than one depression can be provided if a plurality of temperature-regulating devices or control devices are to be installed, or if various components of these devices are to be arranged at different locations. Depending on the purpose of the application, sections of thermoelastic material can moreover be inserted in one or a plurality of parts.

Figure 14:
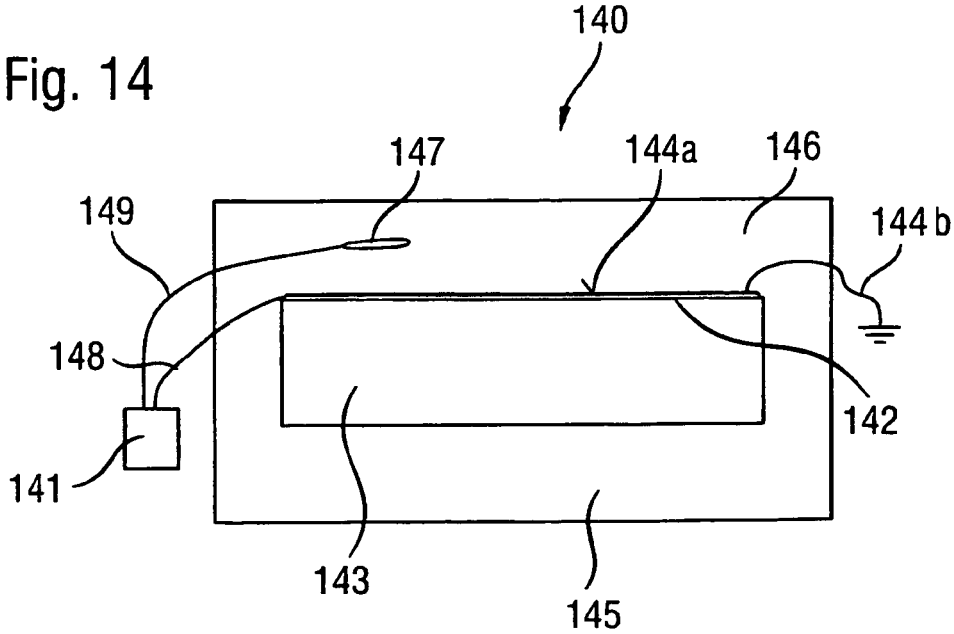
FIG. 14 shows schematically in section a third embodiment of the shaped body as a mattress.

FIG. 14 illustrates schematically a cross-sectional view of a further embodiment of the shaped body as a mattress 140. A recumbent person can be located on the side of the mattress 140 illustrated as the upper side in FIG. 14. The section 143 of thermoelastic, viscoelastic foamed material is combined with an upper section 146 and a lower section 145 of a plastic material, in the present example a foamed material, which at room temperature has a lower firmness than the section 143 of thermoelastic, viscoelastic foamed material. Here the sections 145, 146 are of a conventional, i.e. not thermoelastic and viscoelastic, foamed material, in which no discernible temperature dependence of the firmness can be established, in particular in the temperature range between room temperature and body temperature. In the example illustrated in FIG. 14, the sections 145, 146 are designed in one part. In further variants they can also be designed in multiple parts. Likewise further sections can be provided of a conventional or a thermoelastic and viscoelastic plastic material. Also in many variants an upper section 146 can be dispensed with, so that a recumbent person is lying on the section 145 of thermoelastic, viscoelastic foamed material.

The combination of a section of a thermoelastic, viscoelastic plastic material that is relatively firm at room temperature with an underlying section of a plastic material that is softer at room temperature and whose softness also remains essentially constant at temperatures above room temperature, leads to a reinforcement of the effect of the alteration in firmness of the shaped body having these sections, in particular at higher temperatures, e.g. in the range between approx. 30° C. and body temperature, in which many thermoelastic, viscoelastic plastic materials show a lesser alteration in firmness than at lower temperatures, e.g. in the range between room temperature and approx. 30° C. If the section of thermoelastic, viscoelastic plastic material has fallen below a certain level of firmness as a result of appropriate temperature regulation, the softness of the underlying soft plastic material section is also perceivable; previously this was masked by the firm section of thermoelastic, viscoelastic plastic material. By the combination of plastic material sections of different levels of firmness and different temperature dependencies of their levels of firmness, moulded bodies can be made available that allow perceivable alterations in firmness in different temperature ranges. In further variants of this embodiment sections of thermoelastic, viscoelastic plastic materials can be combined for this purpose, as long as they have different levels of firmness at different temperatures.

Via a heating fleece 142, which is connected via a heating cable with a control device 141, and is immediately applied to the upper side of section 143 of thermoelastic, viscoelastic foamed material, the temperature of this section 143 is altered so as to achieve an alteration of the firmness. In one variant the heating fleece can be replaced inter alia by a heating film or a textile of heating threads. In each case the prevailing temperature is monitored via the temperature sensor 147, which is arranged at a distance from the temperature-regulating device, here designed as a heating fleece 142. It is understood that two, three, or more temperature sensors can also be provided. The temperature signal is forwarded via the sensor cable 149 to the control device 141, which for its part determines, as a function of the desired firmness and the temperature that is necessary for this purpose on the one hand, and the prevailing temperature, whether an alteration in temperature by means of the temperature-regulating device is necessary or not, and sends an appropriate signal via the heating cable 148 to the heating fleece 142. The positioning of the temperature sensor 147 at a distance from the heating fleece 142 ensures that it is the temperature of the plastic material that is measured, and not the temperature of the heating fleece 142 itself. Particularly preferred is the example illustrated in FIG. 14 where the temperature sensor 147 is arranged on the side of the heating fleece 142 facing towards a recumbent person. By this means the influence of the body heat of the recumbent person on the temperature of the plastic material, and thus also on the firmness, is also taken into account. By positioning the temperature sensor nearer to the recumbent person, or nearer to the temperature-regulating device in question, the control unit weights accordingly the influence of each of these heat sources taken into account.

In the example illustrated in FIG. 14 the heating fleece 142 is provided with a metal coating 144*a*, which serves to shield the recumbent person from the electromagnetic radiation emitted from the heating fleece. So as to achieve a particularly good shielding effect, the metal coating 144*a* is connected to earth. For this purpose it has an earthing cable 144*b*.

It should be noted that the features and properties of the various embodiments here explained can also be combined in any manner depending on the particular application.

REFERENCE NUMERALS

10 cushion
11 control unit
12 cable connection
13 section of thermoelastic material
14 electrically conducting textile threads
15 shielding
16 heat reflector
17 down section
20 futon
21 control unit
22 cable connection
23 section of thermoelastic material
24 heating wire
25 allergen-blocking material
30 upholstered bed
31 control unit
32 support foot
33 section with steel springs
34 heat reflector
35 section of thermoelastic material
36 conducting plastic material layer
37 ventilation duct
40 mattress
41 pump with controller
42 fluid ducte
43 section of thermoelastic material
44 knitted fabric spacer
45 gel layer
46 foamed material section
50 mattress
51 control unit
52 control unit
53 control unit
54 section of thermoelastic material
55 section of thermoelastic material
56 section of thermoelastic material
57 latex section
60 mattress
61 mattress overlay
62 control device
63 heating wire
64 section of thermoelastic material
65 notch
70 wheelchair
71 seat base
72 section of thermoelastic material
73 section of thermoelastic material
74 foamed material'section
75 control device
76 arm rest
80 seating furniture
81 control device
82 upholstered item of thermoelastic material
83 upholstered item of thermoelastic material
84 heating wire
85 heating wire
90 seat
91 control device
92 heating wire arrangement
93 heating wire arrangement
94 upholstery item of thermoelastic material
95 arm rest
100 control device
101 user interface
102 sensor
103 sensor
104 sensor
105 unit for establishing the desired firmness distribution
106 microprocessor
107 unit for outputting the required temperature distribution
108 interface to the temperature-regulating device
121 upper part
122 lower part
123 recess
124 feather
125 groove
140 mattress
141 control device
142 heating fleece
143 thermoelastic, viscoelastic foamed material
144*a* metal coating
144*b* earthing cable
145 foamed material
146 foamed material
147 temperature sensor
148 heating cable
149 sensor cable
201-207 method steps

What is claimed is:

1. A shaped body for use as a bed support or seat base, comprising:

at least one section of thermoelastic and viscoelastic plastic material, a temperature-regulating device, which is arranged in thermal contact with the at least one section of thermoelastic and viscoelastic plastic material, and a control device for the temperature-regulating device, which is equipped so as to adjust a firmness of the at least one section of thermoelastic and viscoelastic plastic material in a controlled manner via alteration of the temperature, and wherein the body is constructed so that the heat generated is used to influence the firmness without it being detected by a user.

2. The shaped body according to claim 1, wherein the at least one section of thermoelastic and viscoelastic plastic material, is of a foamed plastic material.

3. The shaped body according to claim 1, wherein the at least one section of thermoelastic and viscoelastic plastic material, is at least partly of a polyurethane foam.

4. The shaped body according to claim 1, wherein the at least one section of thermoelastic and viscoelastic plastic material has a volumetric weight in the range between 20 $kg/m^3$ and 85 $kg/m^3$.

5. The shaped body according to claim 1, wherein the body has at least one section of a plastic material, which at room temperature has a lower firmness than the at least one section of thermoelastic and viscoelastic plastic material.

6. The shaped body according to claim 5, wherein the at least one section of plastic material of the lower firmness is arranged underneath the at least one section of thermoelastic and viscoelastic plastic material.

7. The shaped body according to claim 1, wherein the temperature-regulating device is designed as electrical heating.

8. The shaped body according to claim 7, wherein electrically conducting textile threads are arranged adjacent to the at least one section of thermoelastic and viscoelastic plastic material.

9. The shaped body according to claim 7, wherein an electrically conducting plastic material layer is arranged adjacent to the at least one section of thermoelastic and viscoelastic plastic material.

10. The shaped body according to claim 1, wherein the temperature-regulating device is in thermal contact with the at least one section of thermoelastic and viscoelastic plastic material via fluid lines.

11. The shaped body according to claim 1, wherein the temperature-regulating device and the control device are designed to operate interactively such that the at least one section of thermoelastic and viscoelastic plastic material has a temperature in the range from 20° C. to 35° C.

12. The shaped body according to claim 1, wherein the body has a knitted fabric spacer.

13. The shaped body according to claim 1, wherein the body has recesses.

14. The shaped body according to claim 1, wherein the body has a layer that shields electromagnetic radiation.

15. The shaped body according to claim 14, wherein the shielding layer is adapted to be connected to earth in a conducting manner.

16. The shaped body according to claim 1, wherein the body has a heat-reflecting layer.

17. The shaped body according to claim 1, wherein the body has an allergen-blocking material.

18. The shaped body according to claim 1, wherein the body has a gel layer.

19. The shaped body according to claim 1, wherein the body has at least one sensor that is connected to the control device so that a signal of the sensor is taken into account in the adjustment of a firmness.

20. The shaped body according to claim 19, wherein the sensor is designed as a temperature sensor and is arranged at a distance from the temperature-regulating device.

21. The shaped body according to claim 1, wherein it is structured in multiple parts, wherein the individual parts are connected with one another in a form fit and at least one of the parts has a recess for the purpose of accommodating the temperature-regulating device or the control device or a combination thereof.

22. A control device for a shaped body according to claim 1, which is equipped so as to adjust the firmness of one or a plurality of sections of thermoelastic and viscoelastic plastic material in a controlled manner via alteration of the temperature.

23. The control device according to claim 22, wherein the control device is equipped to interact with the temperature-regulating device such that an input concerning a desired firmness is converted into a required temperature range, and from this a corresponding output signal to the temperature-regulating device is generated.

24. The control device according to claim 22, wherein the control device is adjustable so as to adjust to different levels of firmness automatically at different times by means of corresponding alterations in temperature.

25. The control device according to claim 22, wherein the control device is adjustable so as to adjust to different levels of firmness at different locations simultaneously.

26. The control device according to claim 22, wherein the control device has at least one sensor whose signal is evaluated for the control or adjustment to a desired firmness.

27. The control device according to claim 22, wherein the control device has a unit for establishing a desired firmness distribution, a microprocessor for the purpose of determining a required temperature distribution, and a unit for outputting a required temperature distribution.

28. A shaped body for use as a bed support or seat base, comprising:

at least one section of thermoelastic and viscoelastic plastic material, a temperature-regulating device, which is arranged in thermal contact with the at least one section of thermoelastic and viscoelastic plastic material, and a control device for the temperature-regulating device, which is equipped so as to adjust a firmness of the at least one section of thermoelastic and viscoelastic plastic material in a controlled manner via alteration of the temperature, and wherein the body is constructed so that the heat generated is used to influence the firmness without it being detected by a user, and wherein the control device maintains the temperature-regulating device at a temperature range between 10° C. and about 35° C.

* * * * *